United States Patent [19]

Petzl et al.

[11] Patent Number: 5,054,577

[45] Date of Patent: Oct. 8, 1991

[54] SELF-JAMMING DESCENDER FOR A ROPE WITH TWO JAMMING POSITIONS

[75] Inventors: Paul Petzl; Pierre Petzl, both of Crolles, France

[73] Assignee: Petzl S.A., Crolles, France

[21] Appl. No.: 598,674

[22] PCT Filed: Mar. 13, 1990

[86] PCT No.: PCT/FR90/00167

§ 371 Date: Oct. 31, 1990

§ 102(e) Date: Oct. 31, 1990

[87] PCT Pub. No.: WO90/10476

PCT Pub. Date: Sep. 20, 1990

[30] Foreign Application Priority Data

Mar. 16, 1989 [FR] France ..... 89 03582

[51] Int. Cl.[5] ..... A63B 29/00

[52] U.S. Cl. ..... 182/5; 182/193; 188/65.5

[58] Field of Search ..... 182/5, 3, 4, 6, 7, 191–193; 188/65.1–65.5

[56] References Cited

U.S. PATENT DOCUMENTS 4,596,314 6/1986 Rogelja ..... 182/5 X

FOREIGN PATENT DOCUMENTS 0303388 2/1989 European Pat. Off. .

2044414 10/1980 United Kingdom .

*Primary Examiner*—Alvin C. Chin-Shue

*Attorney, Agent, or Firm*—Stevens, Davis, Miller & Mosher

[57] ABSTRACT

A self-jamming descender for a rope comprises a first base flange equipped with an articulation spindle and a first fixed pulley, a mobile support plate with an operating lever pivotally mounted on the spindle, and a second pulley securedly united to the support plate and eccentric with respect to the spindle. The second pulley comprises a boss cooperating with a first braking surface of the first pulley when the lever is in a first jamming position. The pivoting support plate is provide with a jamming cleat, separated from the second pulley by a space through which the rope passes, and cooperating with a second braking surface when the handle is moved to a second jamming position. Unjamming of the descender takes place in an intermediate position of the operating lever.

10 Claims, 8 Drawing Sheets

SELF-JAMMING DESCENDER FOR A ROPE WITH TWO JAMMING POSITIONS

BACKGROUND OF THE INVENTION

The invention relates to a self-jamming descender with two jamming positions for a user to descend along a rope, and comprising :

- a first base flange, equipped with a first fixed pulley offset with respect to an articulation spindle, perpendicular to the first flange,
- a second pulley securedly united to a mobile support plate, pivotally mounted around the spindle in a parallel plane to the base flange,
- an operating handle secured to the support plate and second pulley assembly to form a jamming device with two jamming positions of the rope, which is wound in an S in the guide grooves of the two pulleys, unjamming taking place in an intermediate position of the operating lever,
- a second flange parallel to the first base flange with the two pulleys being interposed in a transverse gap, said second flange being retractable to allow the rope to be wound on the pulleys,
- attachment means of the two flanges to a harness,
- and a first braking surface arranged on the first fixed pulley against which the rope is pressed by a boss of the second pulley in a first jamming position of the operating lever.

A descender of this kind is known from the document FR-2,451,752 in which the second pulley is equipped with two bosses cooperating with the first pulley to form a jammer with two jamming positions, when the pivoting operating lever is alternately in two extreme positions. It can be noted that the jamming function of each boss is always exerted on the same intermediate strand of the rope, arranged between the two pulleys. The movement of the operating lever between the two jamming positions is in the order of a quarter-circle, and the manual unjamming action to the intermediate position of the operating lever requires great effort.

SUMMARY OF THE INVENTION

The object of the invention consists in improving the reliability and grip of a self-jamming descender with two jamming positions.

The descender according to the invention is characterized in that the pivoting support plate comprises opposite from the operating lever, a jamming cleat separated from the second pulley by a space for the rope to pass, and that the first pulley is provided with a second braking surface, against which the rope is pressed by the jamming cleat when the operating handle is moved to a second jamming position.

The articulation spindle of the mobile support plate is eccentric with respect to the fictitious center of the second pulley, so as to increase the jamming torque of the rope when the operating lever is urged to the first jamming position.

The space for the support plate to pass between the second pulley and the jamming cleat has passing through it two adjacent strands of a loop of the rope, which is wound on the first pulley.

When the descender is in operation, the right-angle position of the operating handle makes it easier for the user to grip and actuate when movement takes place to the intermediate unjamming position.

The descender is hooked onto the harness by means of a karabiner and connecting strap. The karabiner is positioned in oblong openings of decreasing cross-section provided at the ends of the flanges.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
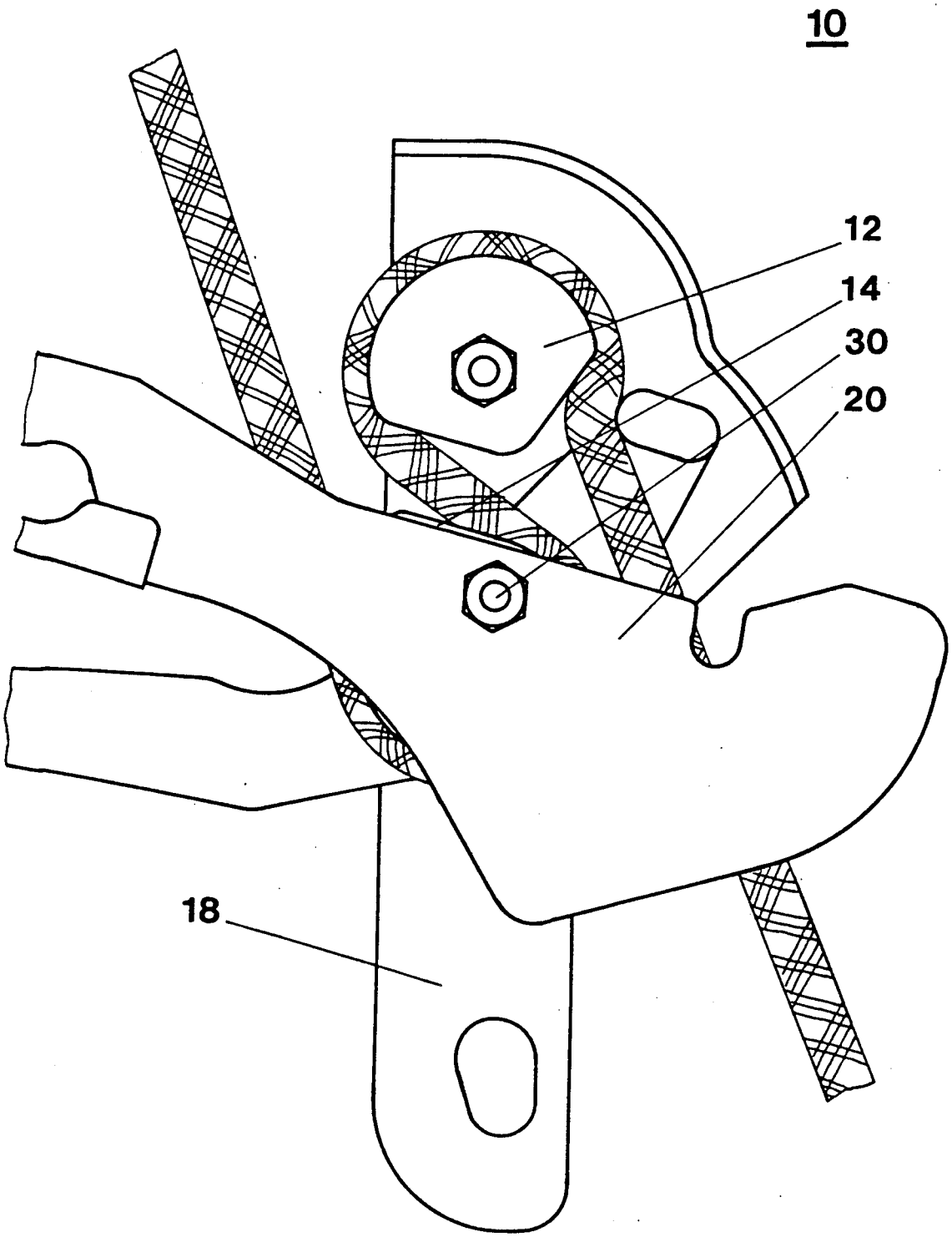
FIG. 1 shows an elevational view of the descender according to the invention, represented with the second flange in the separated position for the rope to be wound onto the pulleys.

In the figures, a self-jamming descender 10 with two jamming positions, comprises a pair of pulleys 12, 14, housed in a transverse gap 16 arranged between two parallel flanges 18, 20. The first pulley 12 is mounted fixed by means of a screw 21 on the first base flange 18, and is immobilized in rotation. The upper circular section of the pulley 12 is equipped with a guide groove 22 of the rope 24. The other part, oriented towards the second pulley 14, is equipped with a first braking surface 26 and a second braking surface 28. The two surfaces 26, 28 are appreciably straight, forming an obtuse angle with one another.

In the middle area of the base flange 18 a fixed spindle 30 protrudes out, extending parallel to the fixing screw 21 of the first pulley 12. A mobile support plate 32 is mounted with limited rotation on the spindle 30, being separated from the base flange 18 by a small axial clearance, allowing pivoting of the support plate 32 inside the gap 16 in a plane parallel to the flange 18. One of the ends of the mobile support plate 32 is extended laterally by an operating lever 34, manual actuation of which controls jamming and unjamming of the rope 24, and the speed of descent. The other end of the support plate 32 is provided with a jamming cleat 36, whereas the second pulley 14 is immobilized in rotation on the support plate 32 between the lever 34 and the cleat 36.

The second pulley 14 is in the shape of a cam comprising a circular section with a guide groove 38 of the rope 24, and a boss 40 designed to cooperate with the first braking surface 26. A circular orifice 42 passes through the pulley 14 to enable the mobile support plate 32 to be mounted on the fixed spindle 30 of the base flange 18.

The orifice 42 is eccentric with respect to the fictitious center 44 of the circular groove 38 of the second pulley 14, so as to increase the torque when automatic jamming occurs following a fall. The orifice 42 is located between the fictitious center 44 of the groove 38 and the straight edge 46 arranged opposite the groove 38.

A space 48 for the rope 24 to pass is arranged between the second pulley 14 and the jamming cleat 36.

Figure 7:
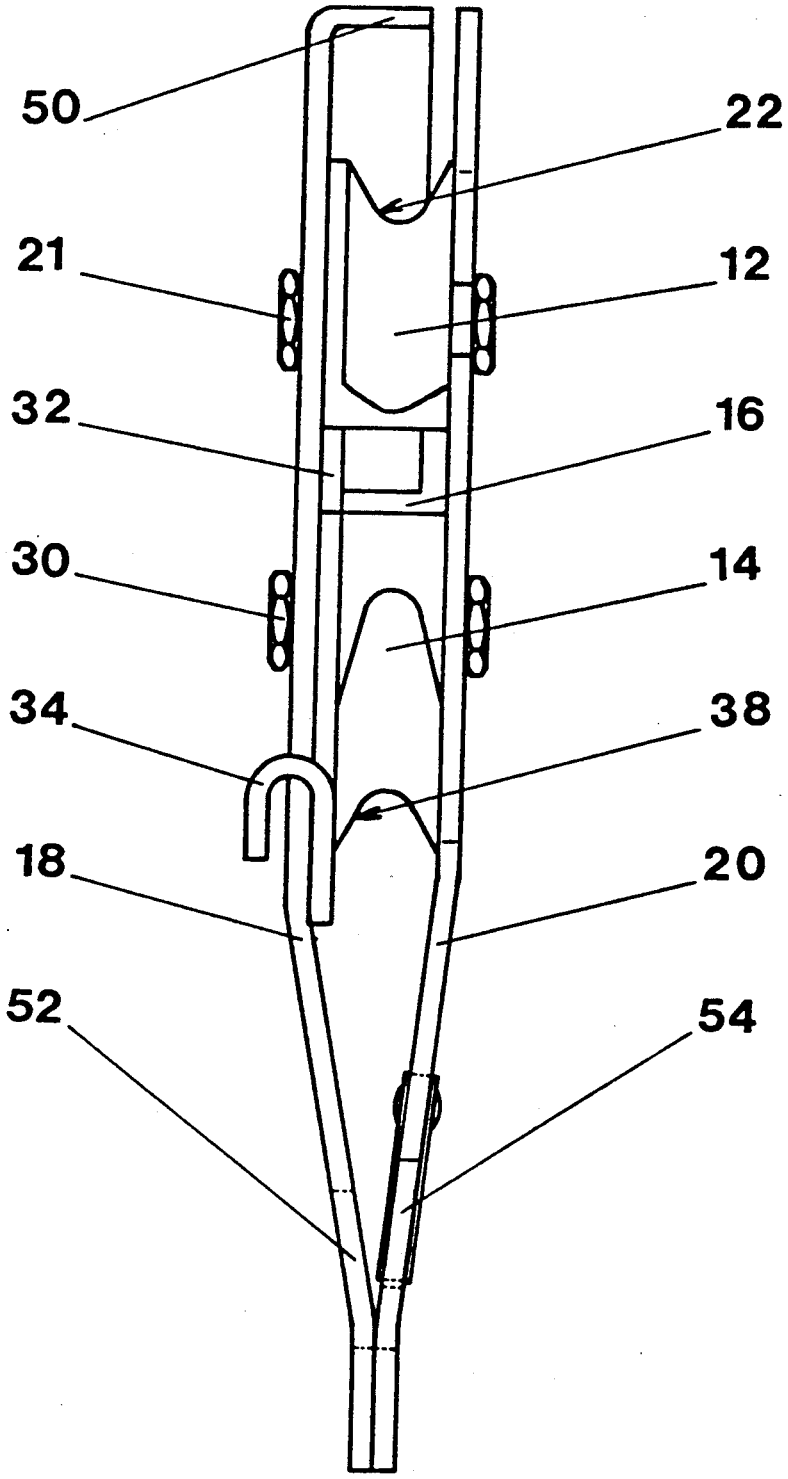
FIG. 7 is a profile view of the descender in the closed position of the second flange.
Figure 8:
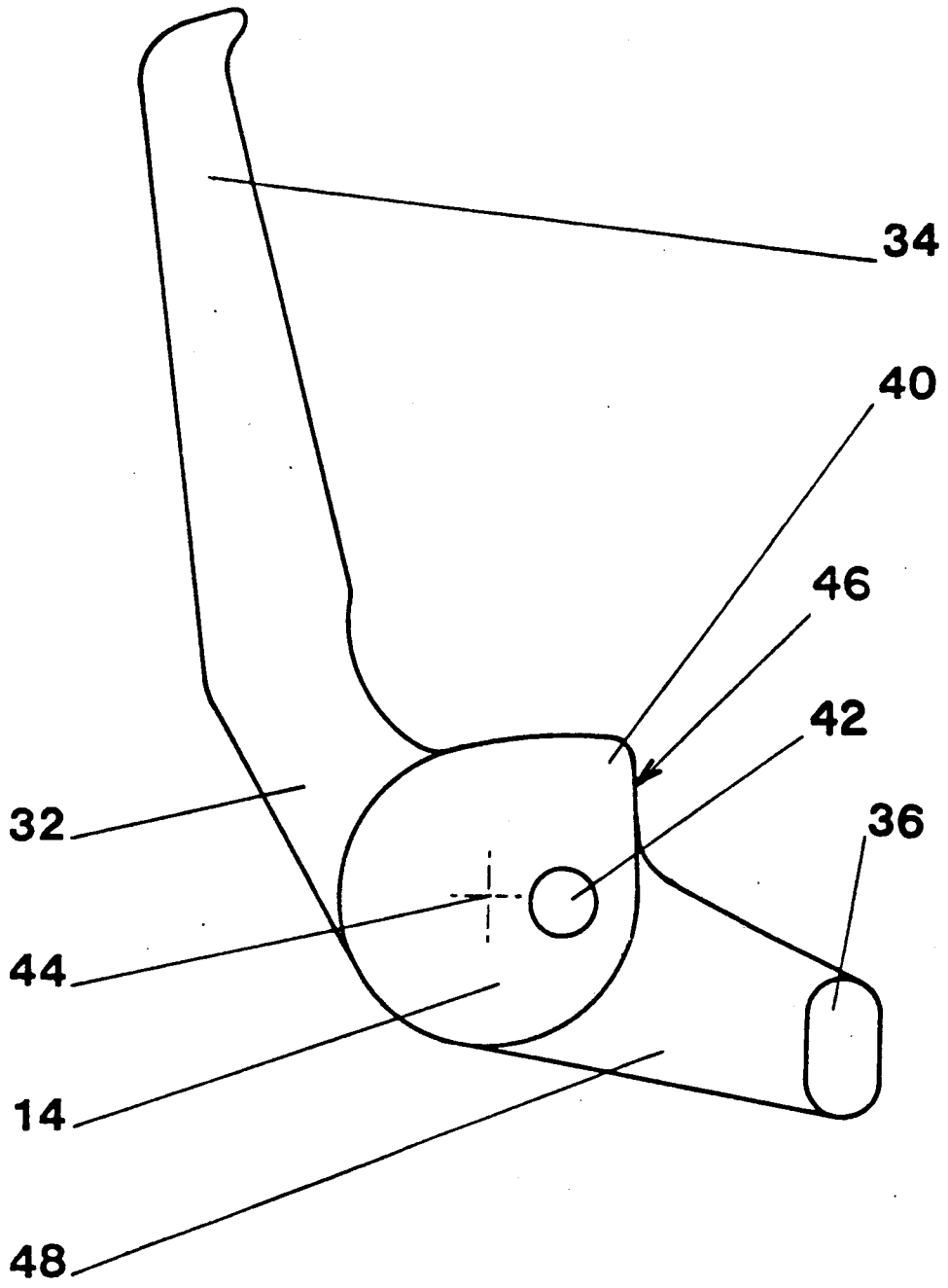
FIG. 8 shows the mobile support plate comprising the operating lever, the second pulley and the jamming cleat.

The second flange 20 blocking off the transverse gap 16, is mounted with scissor swivelling on the fixed spindle 30 between a separated position (FIG. 1) suitable for the rope 24 to be engaged in an S in the guide grooves 22, 38 of the two pulleys 12, 14, and a closed position (FIG. 7) in which the two flanges 18, 20 are disposed facing one another, preventing the rope 24 from being released from the gap 16. The first base flange 18 advantageously comprises a bracket-shaped edge 50 facing the second flange 20.

Opposite the edge 50, the first flange 18 is equipped with an oblong opening 52 of downwardly decreasing cross-section. The second flange 20 also comprises an opening 54 of the same shape, designed to come into alignment in the closed position with the conjugate opening 52, to enable the karabiner, attached to the user's harness, to be fitted. An articulated ratchet is associated with the opening 52 of the second flange 20 for ease of fitting of the karabiner.

Operation of the self-jamming descender 10 is as follows :

After the second flange 20 has swivelled to the separated position (FIG. 1), the user winds the rope 24 around the groove 38 of the second pulley 14, then passes it through the intermediate gap bounded by the edge 46 and the first braking surface 26. The rope 24 then passes in the groove 22 of the first pulley 12, and then in the adjacent space 48 between the jamming cleat 36 and the edge 46. Reclosing of the second flange 20 traps the rope 24 in the gap 16, and any accidental separation of the flanges 12, 14 is prevented by the presence of the karabiner in the openings 52, 54. The decreasing cross-section of the openings 52, 54 enables the karabiner to be positioned and centered correctly regardless of its size.

Figure 2:
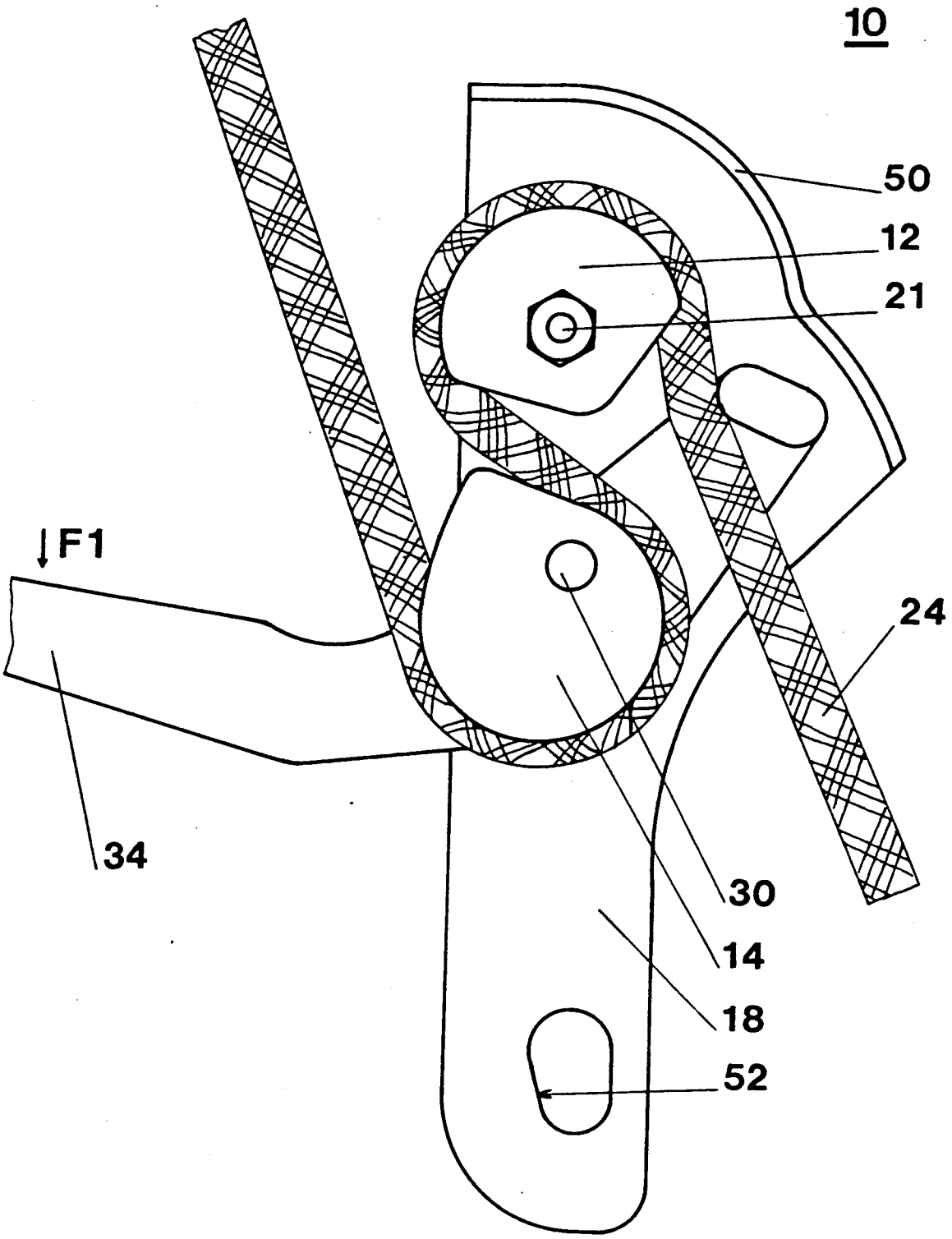
FIG. 2 is an identical view to FIG. 1, in the intermediate unjamming position of the operating handle, the second flange not being represented for greater clarity.

FIG. 2 shows the descender 10 in the unjammed position, corresponding to the intermediate position of the operating handle 34, allowing downward movement of the user along the vertical rope 24. The speed of descent is controlled by the friction of the rope 24 in the two grooves 22, 38 of the pulleys 12, 14. The handle 34 being in the intermediate position results from a voluntary action exerted manually by the user in the direction of the arrow F1. This results in a predetermined counterclockwise pivoting of the support plate 32 around the spindle 30 so as to counteract the reaction of the boss 40 and jamming cleat 36 on the rope 24.

Figure 3:
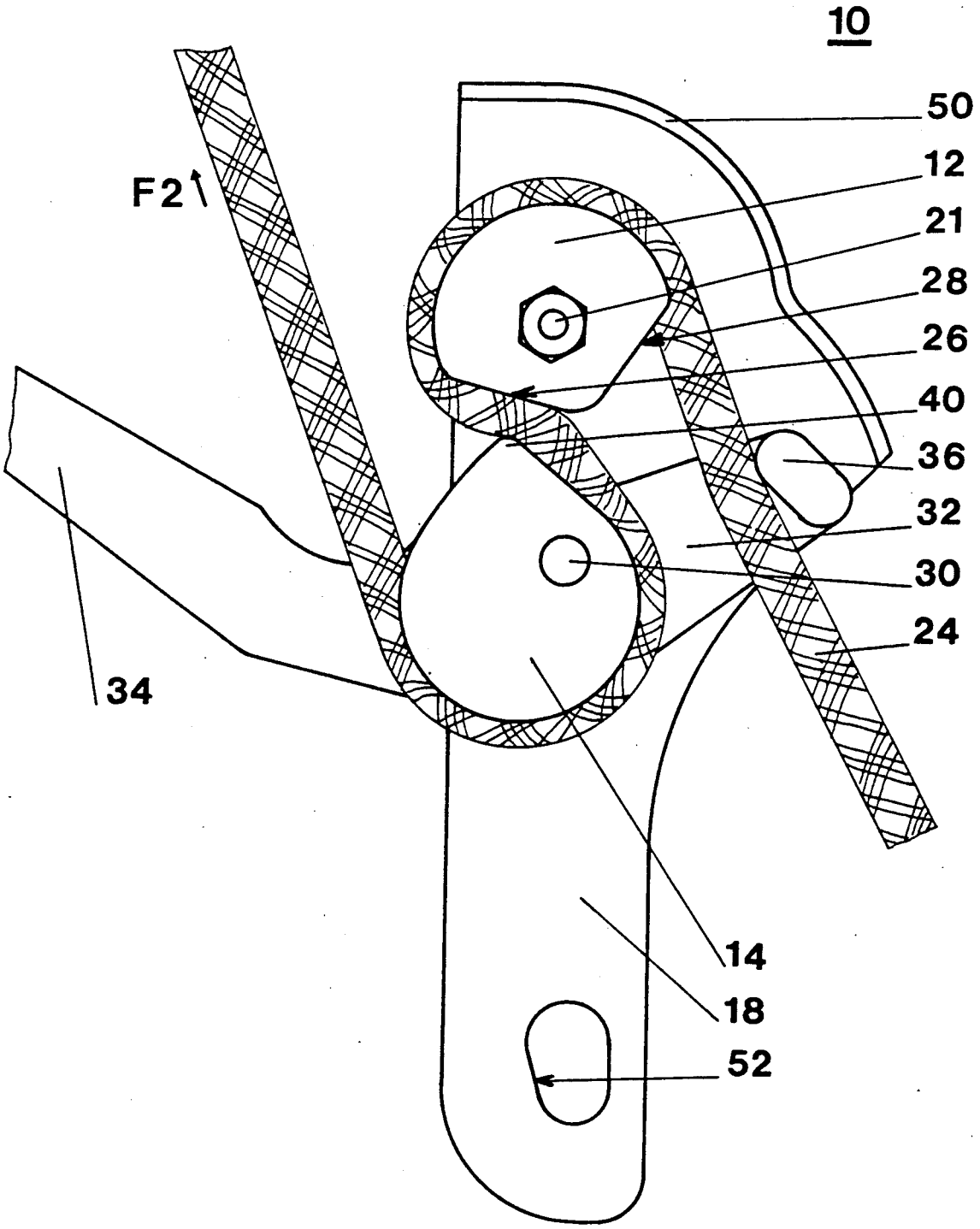
FIG. 3 and 4 are identical views to FIG. 2, the descender being represented respectively in a first and in a second jamming position of the handle.

If the operating handle 34 is released, notably following an uncontrolled fall, the friction forces generate a tension on the rope 24 (see arrow F2, FIG. 3) which urges the mobile support plate 32 clockwise. The boss 40 of the second pulley 14 jams the rope 24 against the first braking surface 26 of the first pulley 12, and automatically arrests the downward movement. The user then remains suspended in complete safety on the rope 24, and the operating handle 34 occupies a first raised jamming position. In this position, the jamming torque of the rope is at its highest, due to the eccentricity of the second pulley 14. The jamming cleat 36 is inactive, being fully separated from the second braking surface 28.

From this first jamming position, unjamming is normally achieved by manually lowering the handle 34 according to the arrow F1 to the intermediate position in FIG. 2.

This unjamming action is made easier by the protruding position of the operating lever 34, which extends appreciably at right angles to the base flange 18.

Figure 4:
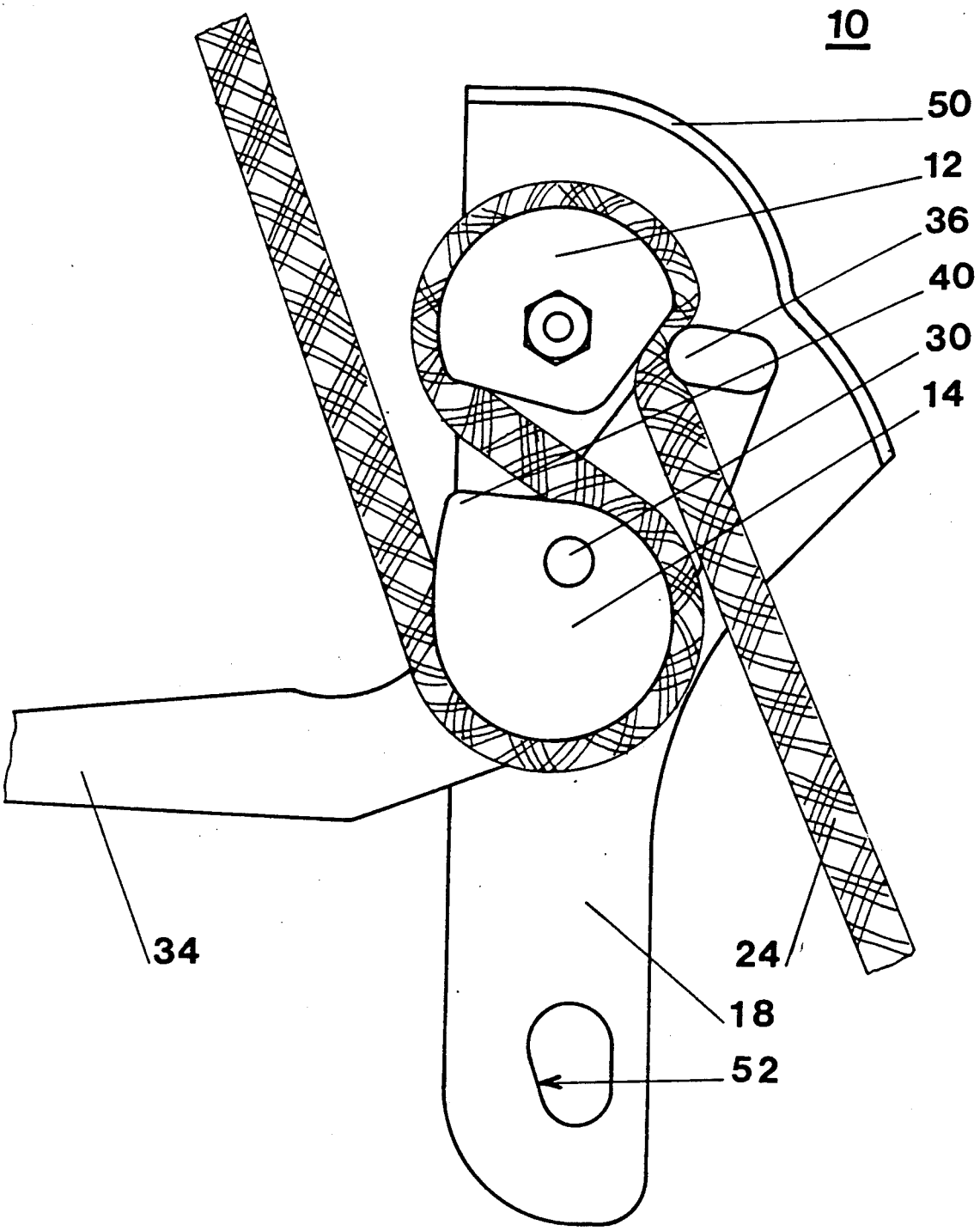

Continued movement beyond the intermediate position brings the support plate 32 and operating handle 34 to a second lowered jamming position (FIG. 4), in which the jamming cleat 36 presses the rope 24 against the second braking surface 28 of the first pulley 12. The second pulley 14 does not exert any jamming effect on the rope 24, as the edge 46 is appreciably parallel to the first braking surface 26. Unjamming of the rope 24 takes place automatically by raising the operating handle 34 to the intermediate position.

Figure 5:
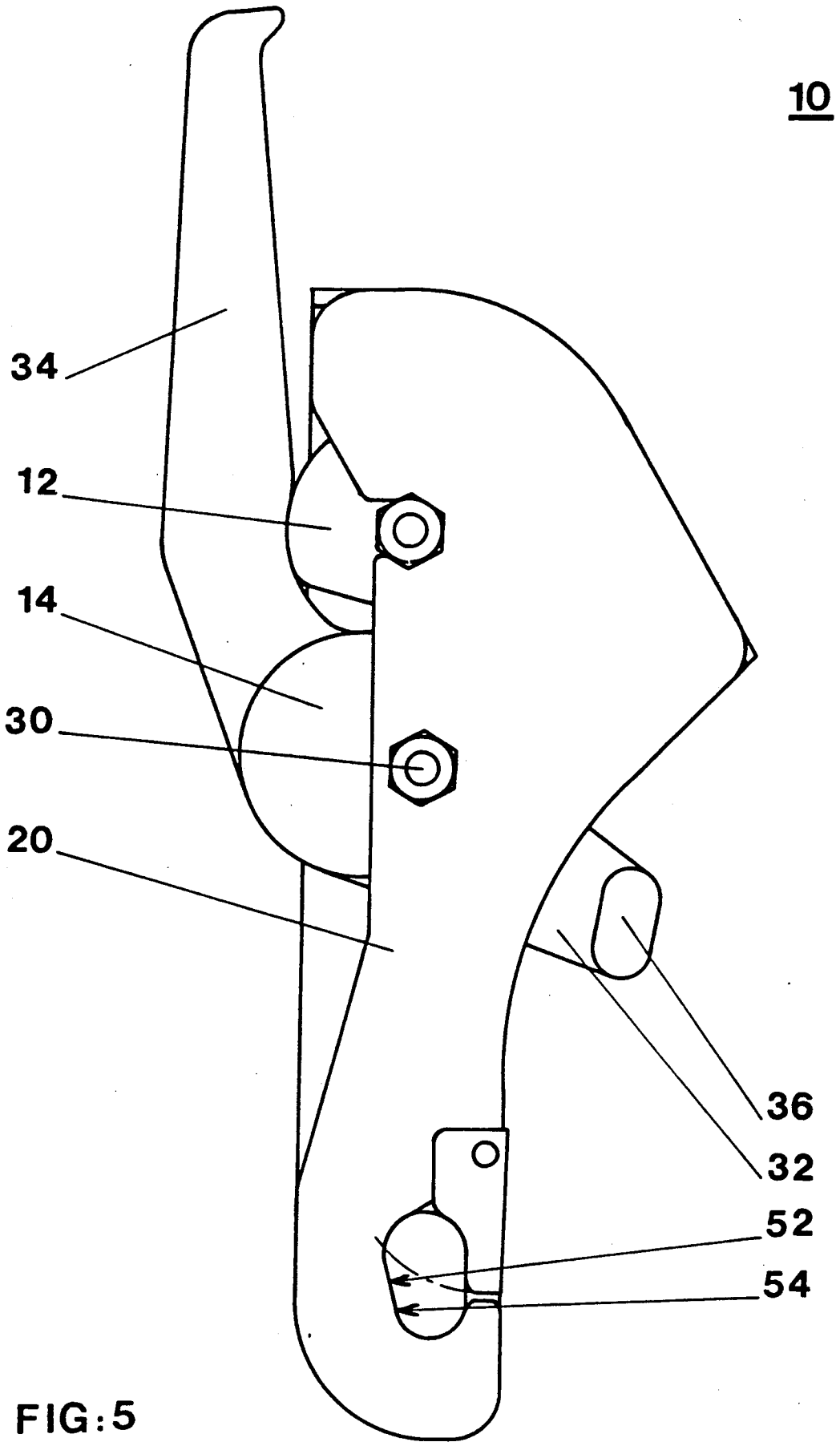
FIG. 5 shows the descender in the rest position during transport.
Figure 6:
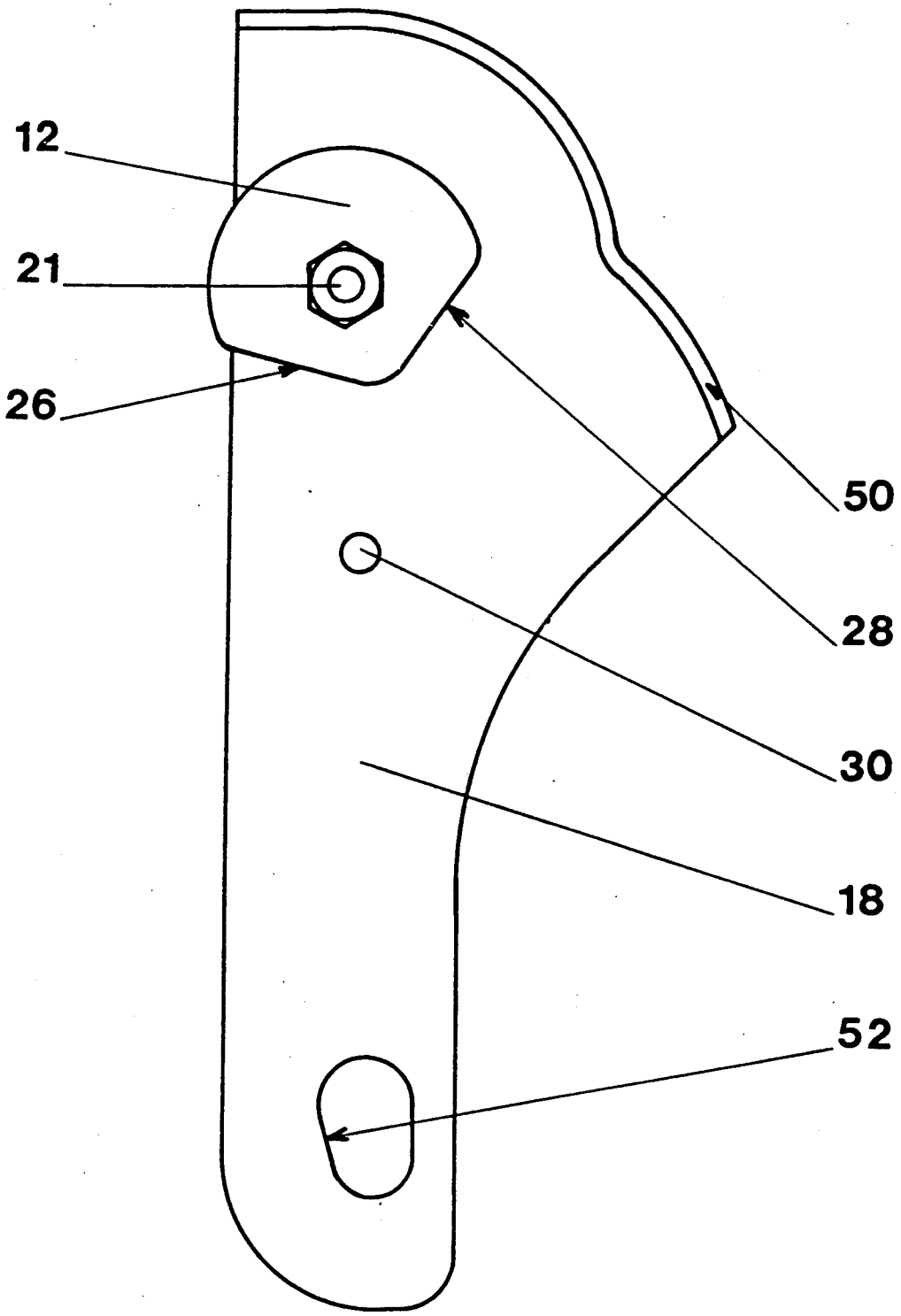
FIG. 6 represents the first base flange equipped with the first pulley and the articulation spindle.

FIG. 5 shows the state of the descender 10 not in operation, notably during transport. The shape and eccentricity of the second pulley 14 allow, in the absence of the rope 24, free pivoting of the operating lever 34 beyond the first position, without the boss 40 touching the first braking surface 26. The handle 34 is then appreciably parallel to the flanges 18, 20, and is no longer protruding. The descender 10 can be transported without any inconvenience for the user.

According to an alternative embodiment, the orifice 42 of the second pulley 14 is arranged coaxially on the fictitious center 44.

The invention also extends to a descender for a double rope, wherein each pulley 12, 14 comprises two juxtaposed guide grooves of the rope 24.

We claim:

1. A self-jamming descender with two jamming positions for a user to descend along a rope, and comprising :

a first base flange, equipped with a first fixed pulley offset with respect to an articulation spindle, perpendicular to the first flange, a second pulley securedly united to a mobile support plate, pivotally mounted around the spindle in a parallel plane to the base flange, an operating handle secured to the support plate and second pulley assembly to form a jamming device with two jamming positions of the rope, which is wound in an S in guide grooves of the two pulleys, unjamming taking place in an intermediate position of the operating lever, a second flange parallel to the first base flange with the two pulleys being interposed in a transverse gap, said second flange being retractable to allow the rope to be wound on the pulleys, attachment means on the two flanges to attach a harness, and a first braking surface arranged on the first fixed pulley against which the rope is pressed by a boss of the second pulley in a first jamming position of the operating lever, wherein the pivoting support plate comprises opposite from the operating lever, a jamming cleat separated from the second pulley by a space for the rope to pass, and the first pulley is provided with a second braking surface, against which the rope is pressed by the jamming cleat when the operating handle is moved to a second jamming position.

2. The self-jamming descender according to claim 1, wherein the first and second braking surfaces of the first fixed pulley are appreciably straight and form an obtuse angle with one another, and the operating lever in the intermediate position protrude appreciably at right angles with respect to the base flange.

3. The self-jamming descender according to claim 1, wherein the articulation spindle is eccentric with respect to a fictitious center of the second pulley, so as to increase a jamming torque of the rope when the operating lever is urged to the first jamming position.

4. The descender according to claim 3, wherein the second pulley is provided with a circular orifice, in which the articulation spindle is engaged when the support plate is mounted, the orifice being located between said fictitious center and an edge arranged opposite from the groove of said second pulley.

5. The descender according to claim 4, wherein the edge of the second pulley extends appreciably parallel to the first braking surface of the first pulley when movement of the operating handle takes place between the intermediate position and the second jamming position.

6. The descender according to claim 1, wherein the second pulley is mounted coaxially on the spindle of the first base flange.

7. The descender according to claim 1, wherein the gap for the rope to pass between the second pulley and the jamming cleat has passing through it two adjacent strands of a loop of the rope, which is wound on the first pulley.

8. The descender according to claim 7, wherein the second flange is mounted by scissor swivelling action on the articulation spindle of the descender between a separated position and a closed position.

9. The descender according to claim 8, wherein the first base flange is provided with a bracket-shaped edge facing the second flange when the latter is in the closed position.

10. The descender according to claim 1, the attachment means of the descender comprising an oblong opening, at the end of each flange on the second pulley side, for a karabiner to be fitted, wherein each opening presents a decreasing cross-section enabling the karabiner to be positioned and centered correctly, whatever the shape of the latter.

* * * * *